US009161666B2

(12) United States Patent
Conrad

(10) Patent No.: US 9,161,666 B2
(45) Date of Patent: Oct. 20, 2015

(54) SURFACE CLEANING HEAD

(75) Inventor: Wayne Ernest Conrad, Hampton, CA (US)

(73) Assignee: Omachron Intellectual Property Inc., Hampton, Ontario ( * ) Notice: Subject to any disclaimer, the term of this patent is extended or adjusted under 35 U.S.C. 154(b) by 403 days.

(21) Appl. No.: 12/721,286

(22) Filed: Mar. 10, 2010

(65) Prior Publication Data

US 2010/0229337 A1 Sep. 16, 2010

(30) Foreign Application Priority Data

Mar. 13, 2009 (CA) ..... 2658369

(51) Int. Cl.
*A47L 5/28* (2006.01)
*A47L 9/02* (2006.01)
*A47L 9/24* (2006.01)

(52) U.S. Cl.
CPC ... *A47L 5/28* (2013.01); *A47L 9/02* (2013.01); *A47L 9/242* (2013.01)

(58) Field of Classification Search
CPC ..... A47L 5/362; A47L 5/36; A47L 9/242; A47L 9/00; A47L 5/365; A47L 5/28; A47L 9/02
USPC ..... 15/415.1, 327.1, 412, 319, 320
See application file for complete search history.

(56) References Cited

U.S. PATENT DOCUMENTS

| | | | | | |
|---|---|---|---|---|---|
| 1,782,882 | A * | 11/1930 | Rippey | 15/420 |
| 2,205,877 | A * | 6/1940 | Dunbar | 15/368 |
| 3,036,325 | A * | 5/1962 | Black, Jr. | 15/312.2 |
| 4,395,794 | A * | 8/1983 | Duncan | 15/420 |
| 4,665,582 | A * | 5/1987 | Richmond et al. | 15/344 |
| 5,101,534 | A * | 4/1992 | Watanabe et al. | 15/377 |
| 5,557,822 | A * | 9/1996 | Yagi et al. | 15/369 |
| 7,673,370 | B2 * | 3/2010 | Frederick et al. | 15/354 |
| 8,151,408 | B2 * | 4/2012 | Finke et al. | 15/327.2 |
| 2006/0101604 | A1 * | 5/2006 | Frederick et al. | 15/319 |
| 2006/0179604 | A1 * | 8/2006 | Boddy et al. | 15/377 |
| 2008/0047093 | A1 * | 2/2008 | Gordon | 15/320 |
| 2009/0094788 | A1 * | 4/2009 | Krebs | 15/412 |

* cited by examiner

*Primary Examiner* — Robert Scruggs
(74) *Attorney, Agent, or Firm* — Philip C. Mendes da Costa; Bereskin & Parr LLP/S.E.N.C.R.L., s.r.l.

(57) ABSTRACT

A surface cleaning head comprises an upper section and a lower section. A front portion of the upper section extends forwardly of the lower section. At least a section of the front portion is transparent.

22 Claims, 9 Drawing Sheets

100
104

106
162
140
146
116
121
117
112
150
133
135
136
198
113
110
115
147
114
151
122
126
129
132
161
120
118
197
128
167
130
159
190
199
102

SURFACE CLEANING HEAD

CROSS REFERENCE TO RELATED APPLICATIONS

This application claims the benefit of the filing date of Canadian Patent Application No. 2658369, filed Mar. 13, 2009, entitled SURFACE CLEANING HEAD.

FIELD

The specification relates to surface cleaning heads. Preferably, the specification relates to surface cleaning heads for surface cleaning apparatuses such as vacuum cleaners wherein a transparent front portion is provided.

INTRODUCTION

The following is not an admission that anything discussed below is prior art or part of the common general knowledge of persons skilled in the art.

U.S. Pat. No. 4,395,794 discloses a vacuum cleaner intake device formed of a V-shaped housing widening in the direction of working. The housing has a funnel shape nozzle, a fitting at the apex of the nozzle for connection to a source of suction and a pair of arms extending in a V-shape respectively forwardly and laterally of the nozzle. A pair of sidewalls are provided each having a skid at its lower edge elevating the housing above the floor. A hood covers and defines with the arms and the side walls a collection chamber open at the forward and rear edges. Each of the arms are provided on their bottom surface with a pair of spaced battens defining between them an elongated suction groove open to the collection chamber and extending outwardly through the side wall.

SUMMARY

The following introduction is provided to introduce the reader to the more detailed discussion to follow. The introduction is not intended to limit or define the claims.

According to one broad aspect, a surface cleaning head is provided. The surface cleaning head comprises a front end and a rear end. An air flow passage extends from a dirty air inlet to an air outlet. The surface cleaning head further comprises an upper section and a lower section. A front portion of the upper section extends forwardly of the lower section. At least a section of the front portion is transparent.

In some examples, the front portion is transparent. In some examples, the upper portion is transparent.

In some examples, the surface cleaning head has an outer surface, and an outer surface of the upper section and an outer surface of the lower section comprise essentially all of the outer surface of the surface cleaning head.

In some examples, the surface cleaning head has a clam shell construction wherein the upper section and the lower section comprise the clam shell.

In some examples, the dirty air inlet is at the front end, and at least a portion of the airflow passage extends under the section of the front portion that is transparent. The portion of the airflow passage may comprise an open lower sided airflow chamber. The airflow passage may comprise at least a section that has an open lower side.

In some examples, the airflow passage includes an enclosed passage and an enclosed passage inlet, and the surface cleaning head further comprises front wheels. The front wheels may be positioned rearward of the enclosed passage inlet. The front wheels may be positioned under the lower section.

In some examples, lower section is opaque.

In some examples, the upper section has an upward facing portion and the upper section further comprises reinforcing ribs.

In some examples, the upper section comprises a rear portion, a transition portion and the front portion, the rear portion has a higher height then the front portion and the transition portion extends downwardly to the front portion.

In some examples, the front portion comprises a single layer of plastic. The front portion may have a thickness less than 0.1 inch.

It will be appreciated that a surface cleaning head may incorporate one or more of the features of each of these embodiments and examples.

DRAWINGS

DESCRIPTION OF VARIOUS EMBODIMENTS

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Figure 4:
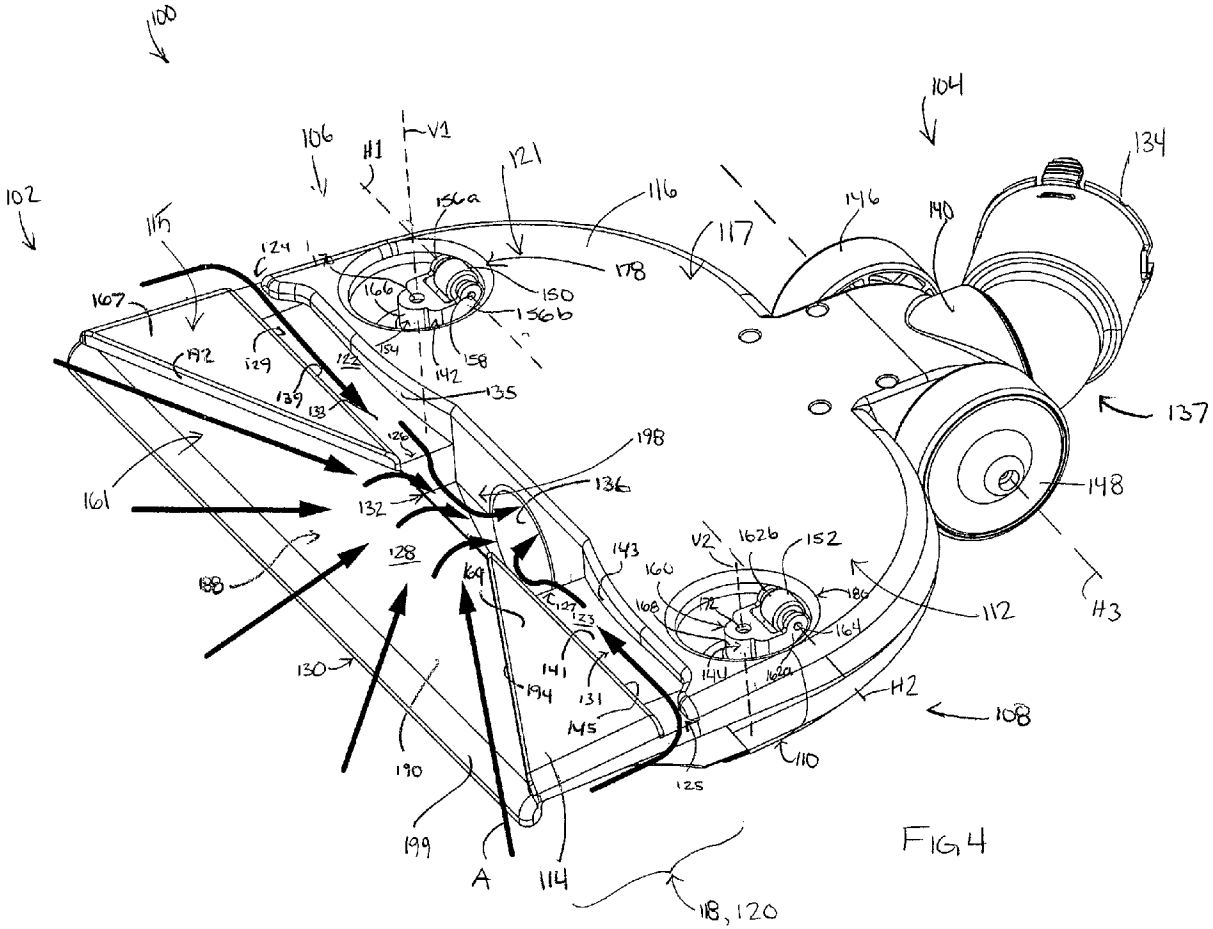
FIG. 4 is a bottom perspective view of the surface cleaning head of FIG. 1.
Figure 5:
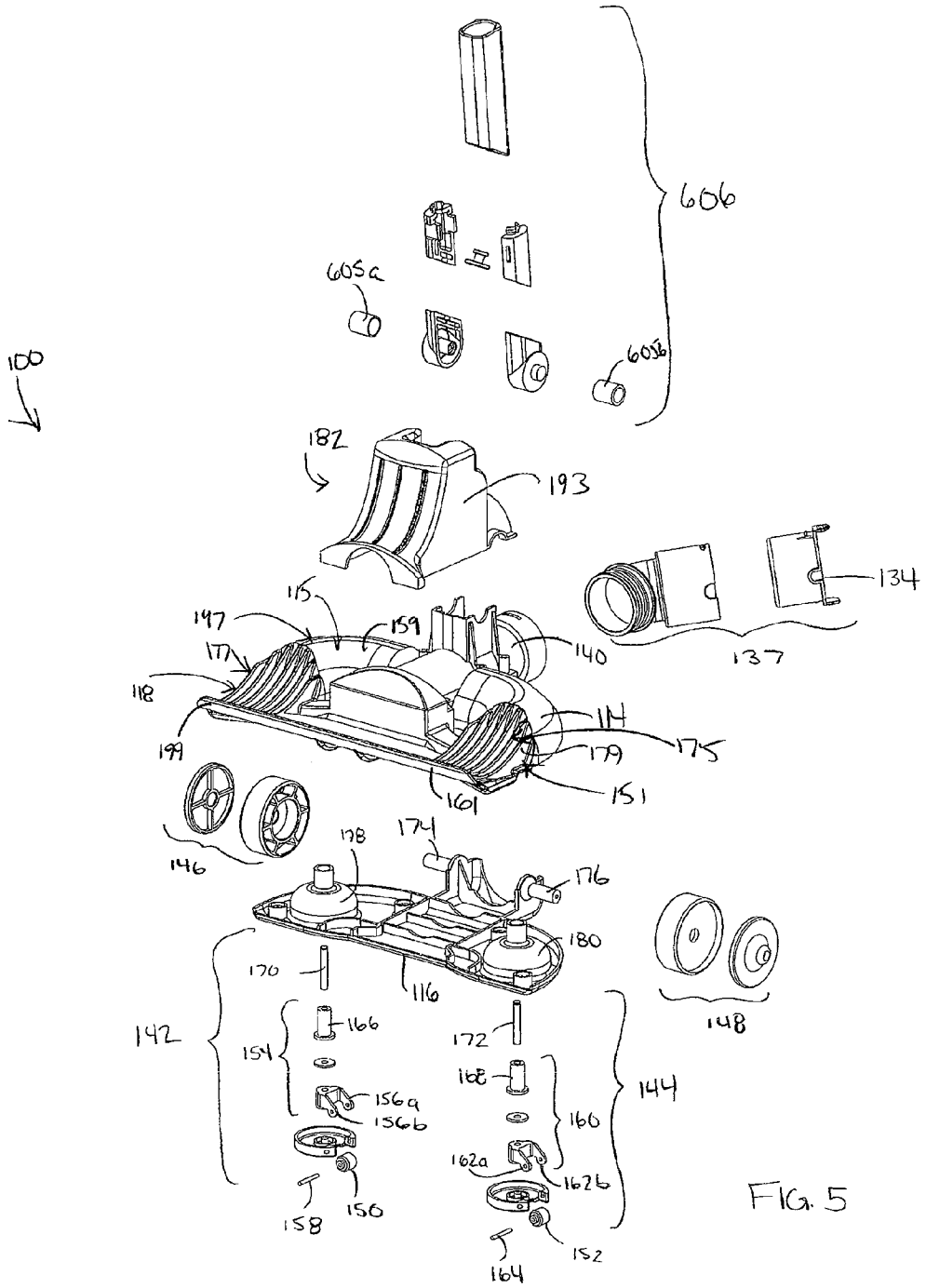
FIG. 5 is an exploded view of the surface cleaning head of FIG. 1.
Figure 6:
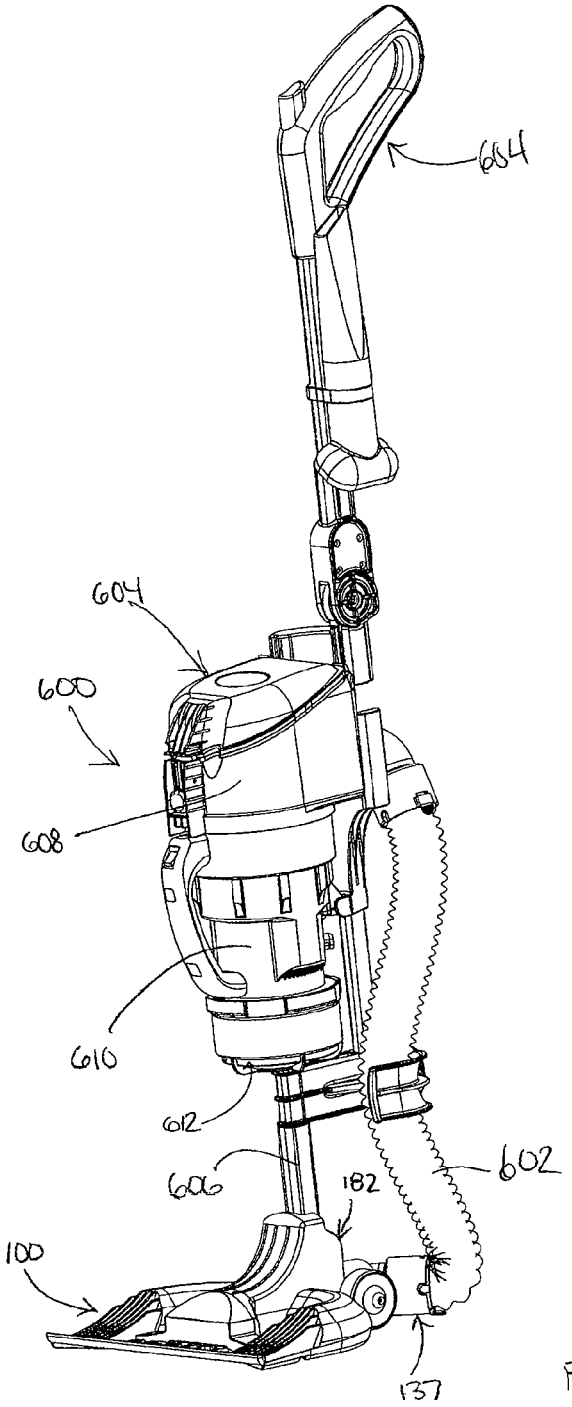
FIG. 6 is a front perspective view of a surface cleaning apparatus comprising the surface cleaning head of FIG. 1.

Referring to FIGS. 1-5 and 7-9, an example of a surface cleaning head 100 is shown. Referring to FIG. 6, as will be described further hereinbelow, the surface cleaning head 100 is connectable in air flow communication to a surface cleaning apparatus 600, such as a vacuum cleaner (e.g., a canister or an upright vacuum cleaner), and preferably, an upright vacuum cleaner.

Figure 1:
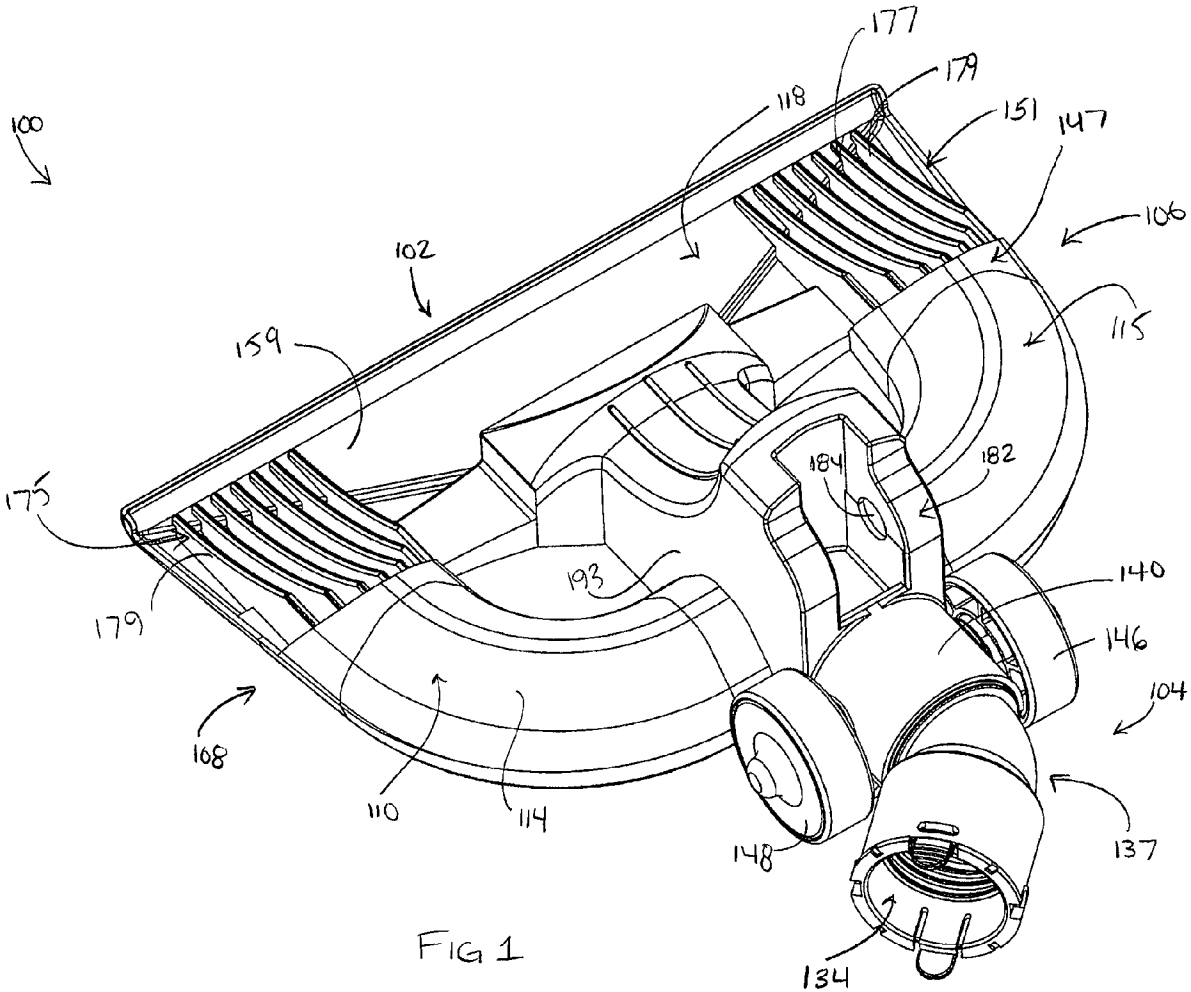
FIG. 1 is a top perspective view of an embodiment of a surface cleaning head.
Figure 2:
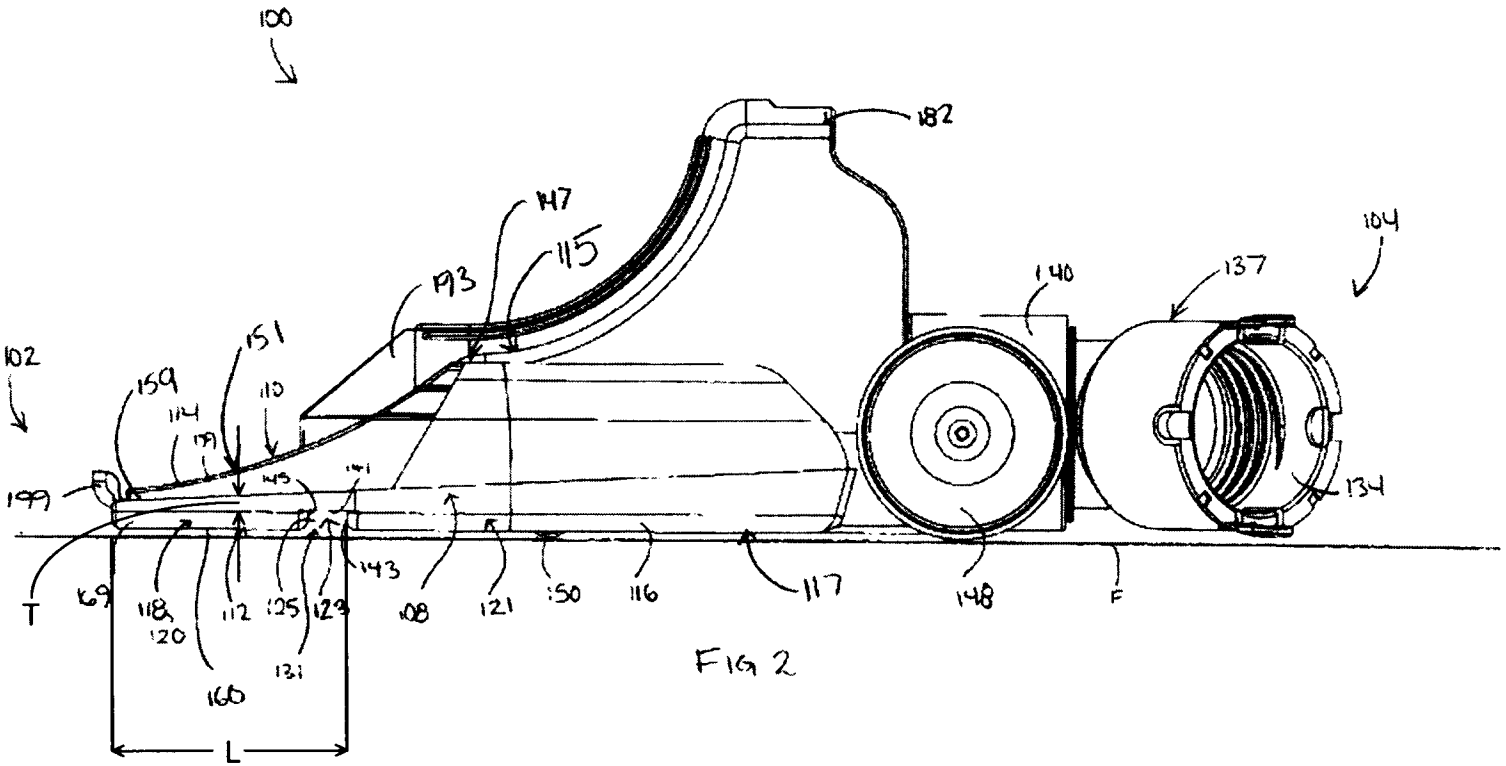
FIG. 2 is a side plan view of the surface cleaning head of FIG. 1.
Figure 3:
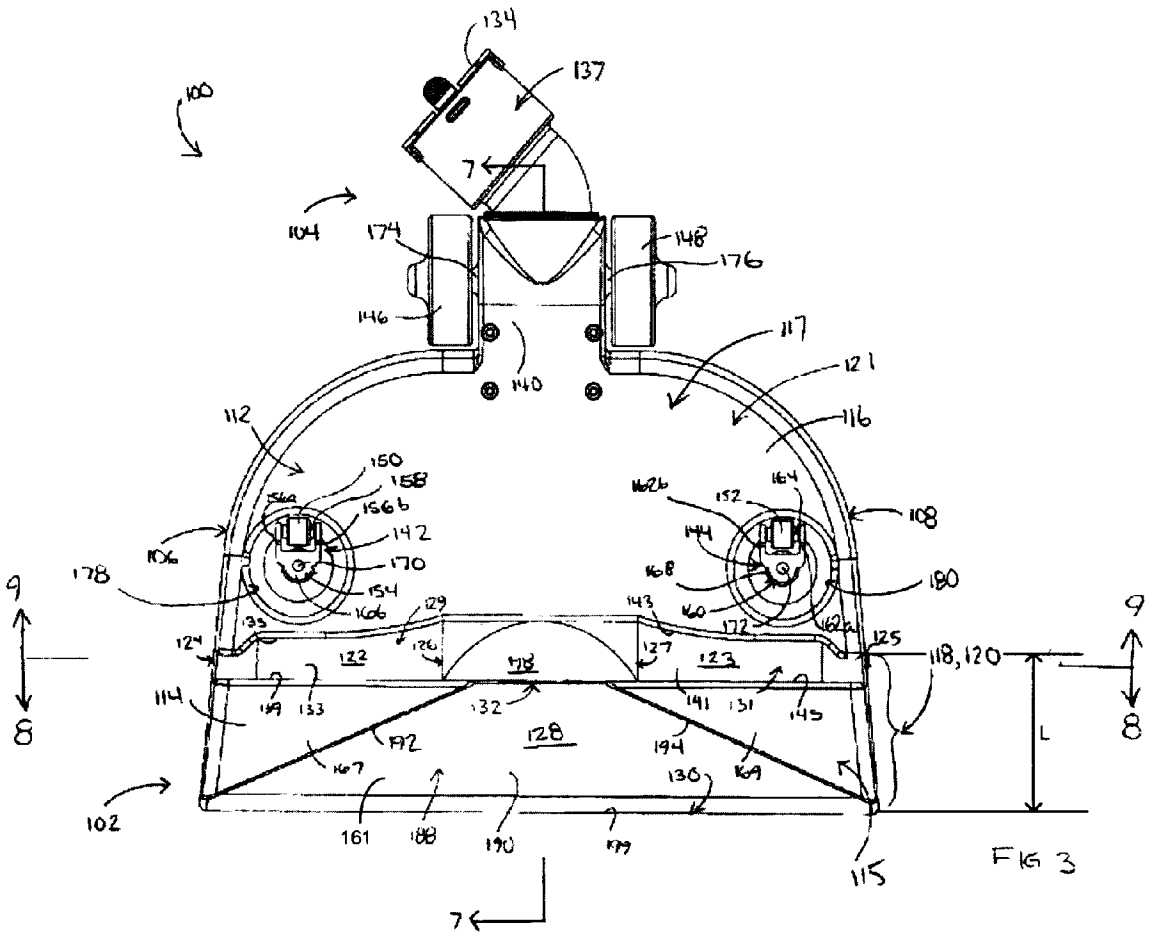
FIG. 3 is a bottom plan view of the surface cleaning head of FIG. 1.

Referring to FIGS. 1 to 3, the surface cleaning head 100 comprises a front end 102, and a rear end 104. The surface cleaning head further comprises first 106 and second 108 opposed lateral sides. A top outer surface 110 and a bottom outer surface 112 each extend between the front end 102 and the rear end 104, and the opposed lateral sides 106, 108. In the exemplified embodiment, the top 110 and bottom 112 outer surfaces form essentially all of the outer surface 101 of the surface cleaning head. It will be appreciated that the surface cleaning head 100 may be of any shape and preferably has a front 102 that is straight. In the exemplified embodiment, the top 110 and bottom 112 outer surfaces form essentially all of the outer surface 101 of the surface cleaning head.

It will be appreciated that the surface cleaning head 100 may be constructed from any number of parts. A simplified construction that may be used is exemplified. In the exemplified embodiment, a clam shell construction is utilized whereby a lower open sided air chamber is formed by having a portion of the top member of the clam shell extend forward of the lower clam shell portion. This construction may be used by itself or with other features of a surface cleaning head set out herein. Preferably, as exemplified, the surface cleaning head 100 comprises a upper section 114, and a lower section 116. The upper section 114 has an outer surface 115, and the lower section 116 has an outer surface 117. The outer surfaces 115, 117 are defined as surfaces that are visible when the surface cleaning head 100 is assembled. Preferably, as in the exemplified embodiment, upper section 114 is an integrally formed plate, and lower section 116 is an integrally formed plate.

The front portion 118 of the upper section 114 extends forwardly of the lower section 116 and has a length "L" as exemplified in FIGS. 2 and 3. Preferably, front portion defines a lower open sided air flow chamber.

As exemplified, at front portion 118 of the upper section 114, the outer surface 115 has an upward facing portion 159, and a downward facing portion 161 and has a thickness "T" that is less than length "L". The downward facing portion 161 forms a front portion 120 of bottom surface 112. Further the outer surface 117 of the lower section 116 forms a rear portion 121 of the bottom surface 112.

Preferably, the front portion 118 of the upper section 114 comprises a single layer of material. For example, the front portion 118 of the upper section 114 may comprise a single layer of plastic. In some embodiments, the plastic may have a thickness less than 0.1 inches.

In the exemplified embodiment, reinforcing ribs 179 are provided on the upward facing portion 159 of the outer surface 115 of upper section 114. The reinforcing ribs 179 may prevent front portion 118 from breaking or deflecting when surface cleaning head 100 is in use, for example if front portion 118 hits a wall. In the embodiment shown, a first set of reinforcing ribs 177 is provided adjacent the first lateral side 106, and a second set 175 of reinforcing ribs is provided adjacent the second lateral side 108. Preferably, the reinforcing ribs are integrally molded with upper section 114

The reinforcing ribs 179 extend upwardly and rearwardly from the front end 102, and increase in height going rearwardly. The ribs 179 merge with a rear portion 147 of the upper section 114, which is at a higher height than the front portion. Accordingly, in the exemplified embodiment, the ribs are at a transition portion 151 of the upper section 114.

In the exemplified embodiment, the outer surface 115 of the upper section 114, and the outer surface 117 of the lower section 116 comprise essentially all of the outer surface of the surface cleaning head. That is, the outer surface 115 of the upper section 114, and the outer surface 117 of the lower section 116 comprise all of the outer surface of the surface cleaning head, excluding an optional pivot mount cover 193, as will be described hereinbelow. In alternate embodiments, other sections (e.g. other plates) may be provided, which may form portions of the outer surface of the surface cleaning head 100.

Preferably, at least a section of the front portion 118 is transparent. For example, the transparent section may be fabricated from a transparent plastic, such as polycarbonate. More preferably, all of the front portion 118 is transparent. For example, in the exemplified embodiment, all of upper section 114 is transparent, including all of front portion 118. Preferably, the lower section 116 is opaque. It will be appreciated that upper section 114 may be tinted.

The surface cleaning apparatus comprises an airflow passage extending from a dirty air inlet 130 to an air outlet 134. Preferably, at least a portion of the airflow passage extends under the section of the front portion 118 that is transparent. More preferably, the airflow passage comprises at least a section that has an open lower side.

For example, as shown, the dirty air inlet 130 is provided at front end 102. A first airflow chamber 128 extends rearwardly from dirty air inlet 130. In the exemplified embodiment, the airflow chamber 128 is integrally formed in front portion 118 of upper section 114. More particularly, the outer surface 115 of the upper section is contoured to form a top wall 190, and opposed side walls 192, 194, of the airflow chamber 128. Accordingly, the airflow chamber 128 extends under front portion 118, and as all of front portion 118 is transparent, the airflow chamber 128 provides the portion of the airflow passage that extends under the transparent section of front portion 118.

In the exemplified embodiment, all of the lower side 188 of the airflow chamber, which extends between the air inlet 130, the rear 132, and the sides 192, 194, is open. In alternate embodiments, only a portion may be open. Any lower open sided construction may be used.

An advantage of using an integrally formed upper section 114 is that front portion 118 may be transparent and may have sufficient strength to permit the front of the cleaning head to comprise a single layer of plastic. If an open sided air flow chamber is provided below front portion 118, which is preferred, then a user may view the air channel and determine if a blockage occurs.

An advantage of the transition region is that reinforcing ribs may be provided to provide rigidity to front portion 118. During use, front portion 118 may vibrate or flex, particularly at high suction. The may affect the efficiency of the vacuum cleaner due to variations in air flow rate in the lower open sided air flow chamber.

Rear end 132 of airflow chamber 128 may be in communication with a manifold 198, which is in communication with an enclosed passage 140 via an enclosed passage inlet 136. The enclosed passage 140 extends rearwardly from the enclosed passage inlet 136. A swivel joint 137 is mounted to a rear end of the enclosed passage 140, and is in airflow communication with the enclosed passage 140. The swivel joint is mountable in airflow communication with the surface cleaning apparatus 600, and comprises the air outlet 134 of the surface cleaning head 100. Any other connection known in the vacuum cleaner arts may be used.

Preferably, as in the exemplified embodiment, the surface cleaning apparatus further comprises a second airflow chamber 122, and a third airflow chamber 123, which form a portion of the airflow passage. The second airflow chamber has an inlet 124 at first lateral side 106, and an outlet 126 in communication with manifold 198. The third airflow chamber 123 has an inlet 125 at second lateral side 108, and an outlet 127 in communication with manifold 198. Inlets 124 and 125 form auxiliary dirty air inlets to surface cleaning head 100. Both the second 122 and third 123 airflow chambers are preferably integrally formed in front portion 118 of upper section 114. For example, the outer surface 115 of the upper section 114 may be contoured to form a top wall 133, and opposed side walls 135, 139 of the second airflow chamber 122, and to form a top wall 141 and opposed side walls 143, 145 of the third airflow chamber 123. In the exemplified embodiment, the second airflow chamber 122 has an open lower side 129, and the third airflow chamber 123 has an open lower side 131. In another embodiment, inlets 124, 125 may not be provided.

The surface cleaning head 100 is preferably configured to transition from a low pile carpet to a high pile carpet. This design may be used by itself or with any other feature disclosed herein. For example, as shown, the front portion 118 of top section 114 comprises an upwardly curved lip 199. Lip 199 is provided at the front 102 of the surface cleaning head 100, above dirty air inlet 130. Accordingly, if surface cleaning head 100 is pushed from a low pile carpet to a high pile carpet, lip 199 will serve as a ramp, and aid in lifting the surface cleaning head 100 from the low pile carpet onto the high pile carpet.

Figure 7:
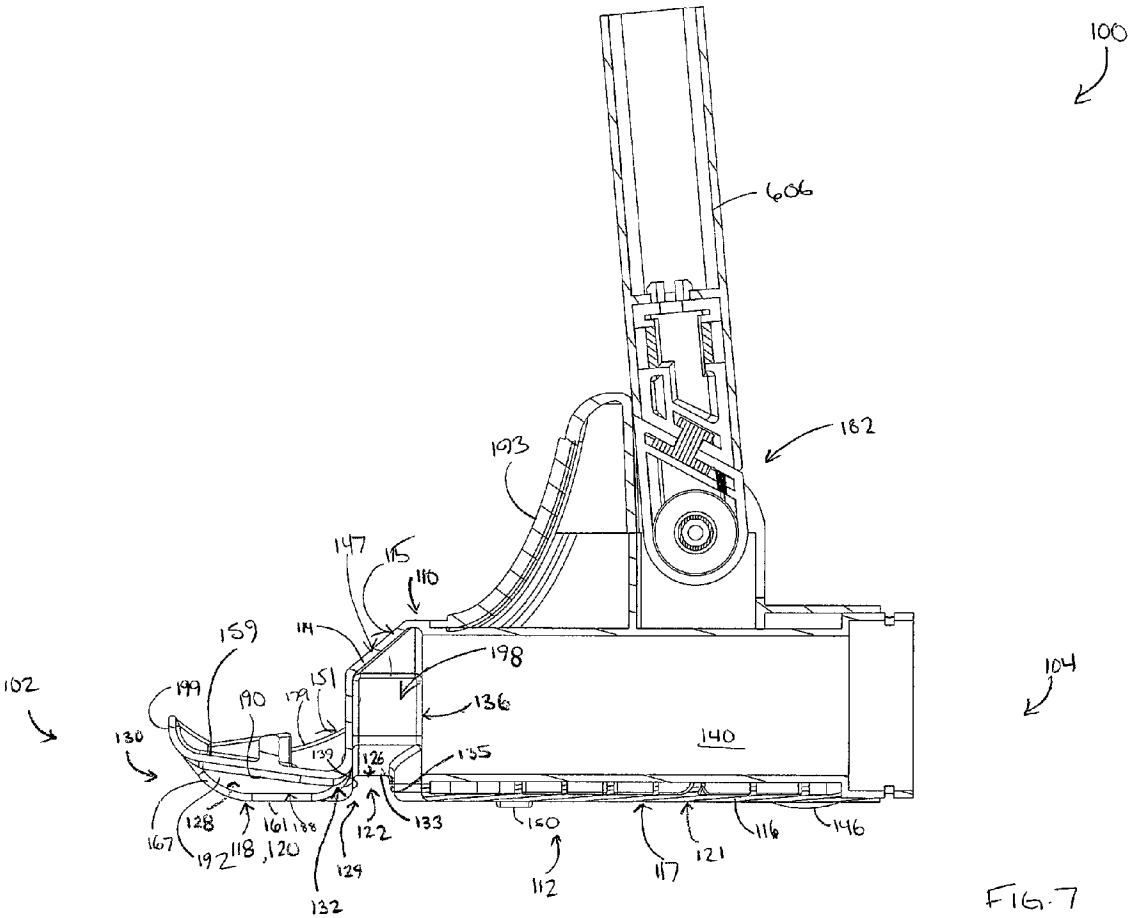
FIG. 7 is a cross-section taken along line 7-7 in FIG. 3.

In some embodiments, the sidewalls 192, 194 of the first airflow passage are formed from triangular members 167 and 169. The triangular members 167, 169 may curve upwardly together with lip 199 at front end 102. This is shown in FIG. 7. The front or leading edge of any side wall for the open lower sided air flow channel may be chamfered, curved or radiused.

Figure 8:
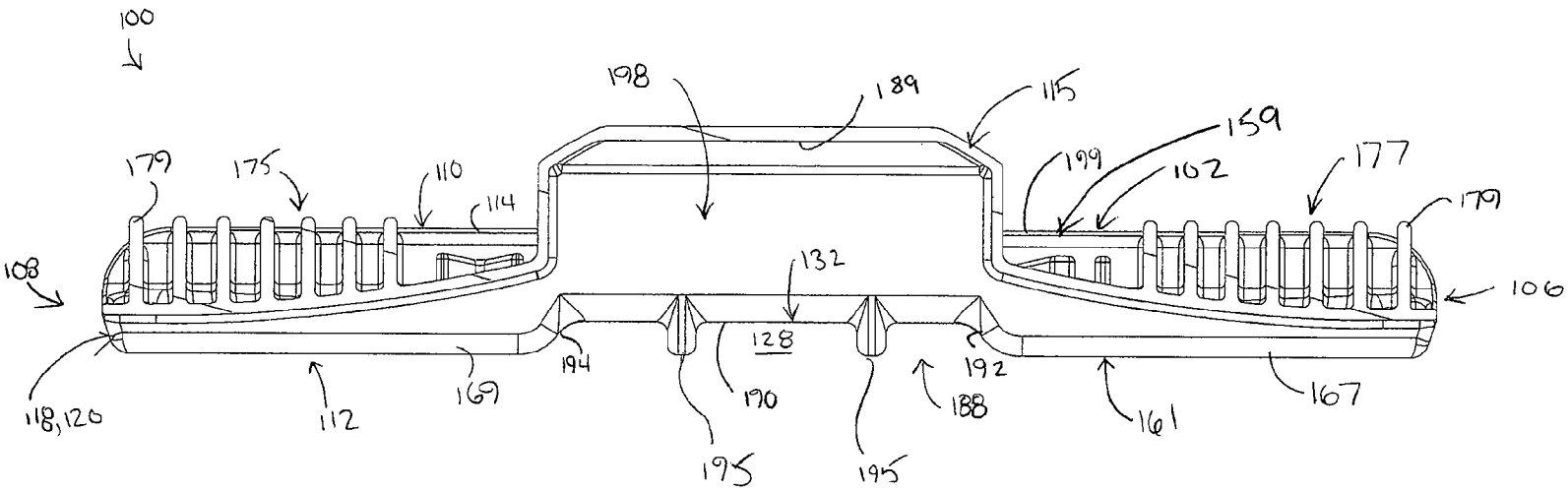
FIG. 8 is a cross-section taken along line 8-8 in FIG. 3.
Figure 9:
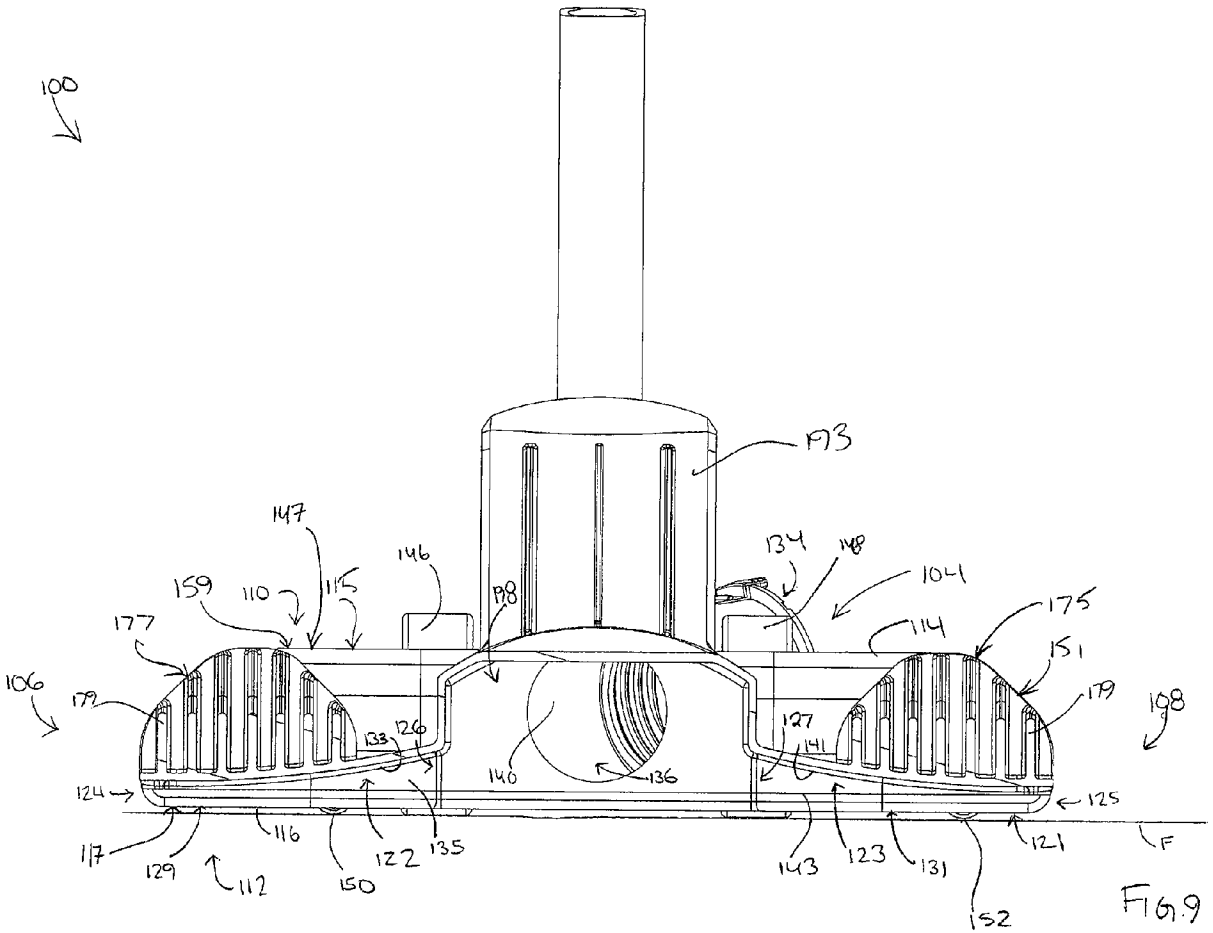
FIG. 9 is a cross-section taken along line 9-9 in FIG. 3.

In some embodiments, ribs that act as carpet holders may be provided, which, in use, hold down a carpet, and prevent the carpet from being lifted upward off of a surface by the flow of air through the open sided airflow passages 128, 122, 123. This design may be used by itself with an lower open sided air flow chamber or with any other feature disclosed herein. For example, as shown in FIG. 8, two carpet holders 195 are provided, which extend downwardly from top wall 190 of first passage 128 and preferably extend in a direction of flow.

Referring to FIGS. 2 to 5, the surface cleaning head 100 preferably comprises at least front wheels. In the exemplified embodiment, the surface cleaning head 100 comprises first 142 and second 144 front wheel assemblies, and first 146 and second 148 rear wheels. Preferably, the front wheel assemblies 142, 144 are rotatable about vertical axes. More preferably, the front wheel assemblies 142, 144 are rotatable about vertical axes, and comprise wheels that are rotatable about horizontal axes. The front wheels may be swivel, caster or ball wheels. This configuration of wheels may be used by itself or with any other feature disclosed herein.

For example, in the exemplified embodiment, the first front wheel assembly 142 comprises a first front wheel 150, and second front wheel 144 assembly comprises a second wheel front 152. The first front wheel assembly 142 further comprises a first bracket 154, having outwardly extending arms 156*a*, 156*b*. The first front wheel 150 is mounted on a first axle 158, which extends horizontally between the arms 156*a*, 156*b*. Accordingly, the first front wheel 150 is rotatable about a horizontal axis H1 defined by first axle 158. The second front wheel assembly 144 further comprises a second bracket 160, having outwardly extending arms 162*a*, 162*b*. The second front wheel 152 is mounted on a second axle 164 which extends horizontally between the arms 162*a*, 162*b*. Accordingly, the second front wheel 152 is rotatable about a horizontal axis H2 defined by axle 164.

As exemplified, the first bracket 154 comprises a first vertically extending portion 166 provided above the outwardly extending arms 156, and the second bracket 160 comprises a second vertically extending portion 168 provided above the outwardly extending arms 162. First 170 and second 172 vertical pins are mounted to the lower section 116, and extend downwardly therefrom. The first vertically extending portion 166 is rotatably received on the first pin 170, and the second vertically extending portion 168 is rotatably received on the second pin 172. Accordingly, the first 154 and second 160 brackets are rotatable about first and second vertical pins 170 and 172, respectively, to rotate first 142 and second 144 front wheel assemblies about vertical axes V1 and V2, respectively.

Preferably, as shown in FIG. 4, the horizontal axis of rotation H1 of the first front wheel 150 is spaced from the vertical axis of rotation V1 of the first front wheel assembly 142, and the horizontal axis of rotation H2 of the second front wheel 152 is spaced from the vertical axis of rotation V1 of the first front wheel assembly 144. For example, as exemplified, outwardly extending arms 156*a*, 156*b* extend laterally away from vertically extending portion 166, such that axle 158, which defines axis H1, is spaced from vertically extending portion 166, which defines axis V1. Similarly, outwardly extending arms 162*a*, 162*b* extend laterally away from vertically extending portion 168, such that axle 164, which defines axis H2, is spaced from vertically extending portion 168, which defines axis V2.

Preferably, as shown in FIG. 4, the rear wheels 146, 148 are rotatable about horizontal axes H3. For example, as shown in FIG. 5, the rear wheels 146, 148 are mounted on axles 174 and 176, respectively, which are fixedly mounted on opposed sides of enclosed passage 140, adjacent rear end 104.

Preferably, as exemplified the front wheels are positioned rearwardly of the enclosed passage inlet 136.

Preferably, the rear wheels 146, 148 are positioned closer together than the front wheel assemblies 142, 144. For example, in the exemplified embodiment, the front wheel assemblies 142, 144 are positioned adjacent lateral sides 106, 108, respectively of the surface cleaning head 100. Further, as mentioned hereinabove, the rear wheels 146, 148 are positioned on opposed sides of enclosed passage 140.

Preferably, the front wheels are positioned under the lower section 116. For example, as shown, the front wheels are mounted to the outer surface 117 of the lower section 116. More preferably, a portion of each front wheel assembly 142, 144, is recessed upwards from the bottom surface 112 of the surface cleaning head 100. For example as shown in FIGS. 3 and 4, a first recess 178 and a second recess 180 are provided in lower section 116, and extend upwardly. The first front wheel assembly 142 is mounted in the first recess 178, such that bracket 154 is completely received within the first recess 178, and a portion of wheel 150 extends from the first recess 178. The second front wheel assembly 144 is mounted in the second recess 180, such that bracket 160 is completely received within the first recess 180, and a portion of wheel 152 extends from the second recess 180. As shown in FIG. 3, this allows bottom surface 112 to sit in close proximity to a floor F.

Preferably, the front wheels 150, 152 have a smaller diameter than the rear wheels 146, 148.

Referring to FIG. 1, surface cleaning head 100 may further comprise a pivot joint 182, which is mounted to upper section 114, and is covered by a cover 193. The pivot joint 182 comprises laterally opposed apertures 184 (only one aperture shown). The pivot joint 182 is positioned between the front wheel assemblies 142, 144 and the rear wheels 146, 148. As shown in FIG. 6, a support 606 of the surface cleaning apparatus 600 is pivotally mounted to the pivot joint 182 by a pivot pins 605*a*, 605*b*.

Referring now to FIG. 6, a surface cleaning apparatus 600 comprising surface cleaning head 100 is shown. It will be appreciated that surface cleaning head 100 may be mounted to any suitable surface cleaning apparatus, and surface cleaning apparatus 600 is exemplary only.

Preferably, as in the embodiment shown, surface cleaning apparatus 600 comprises a flexible hose 602, which is mounted to swivel joint 137 and is in fluid communication with air outlet 134. However, a rigid conduit may also be used. Hose 602 extends upwardly to a cleaning unit 604. The cleaning unit 604 is mounted to support 606, which is pivotally mounted to pivot joint 182 of surface cleaning head 100. The cleaning unit 604 includes a cleaning apparatus 608. The cleaning apparatus 608 is in fluid communication with hose 602, and serves to separate dirt from air. The cleaning apparatus 608 may be any type of cleaning apparatus, such as one or more cyclonic cleaning units, and/or one or more filters. The cleaning unit further comprises a suction motor 610, which draws air into the dirty air inlets of surface cleaning head, through surface cleaning head 100 to outlet 134, through house 602, through cleaning apparatus 608, and out of a clean air outlet 612 of the surface cleaning apparatus 600. A handle 614 is mounted to cleaning unit 604, and may be gripped by a user to move surface cleaning head 100 along a surface.

The invention claimed is:

1. A surface cleaning head comprising:

(a) a front end, a rear end and first and second opposed lateral sides;

(b) a main body having an entrance to an enclosed air flow passage and a front portion that extends forwardly from the enclosed air flow passage, the front portion having a central brushless, planar portion and laterally spaced apart side portions that extend to the first and second opposed lateral sides such that, when the surface cleaning head is positioned on a surface to be cleaned, a lower surface of the front portion is spaced from and faces the surface to be cleaned; and, (c) an air flow passage extending from the front end to an air outlet, the air flow passage includes an open lower sided passage located between the lower surface and the surface to be cleaned when the surface cleaning head is positioned on the surface to be cleaned that extends concurrently horizontally and rearwardly to the entrance to the enclosed passage, wherein each side portion has a depending wall that extends downwardly from the central portion and is angled rearwardly and inwardly to define a sidewall of the open sided passage.

2. The surface cleaning head of claim 1 wherein at least a portion of the front portion is transparent.

3. The surface cleaning head of claim 1 wherein the front portion is transparent.

4. The surface cleaning head of claim 1 wherein the surface cleaning head further comprises front wheels wherein the front wheels are positioned rearward of the entrance to the enclosed passage.

5. The surface cleaning head of claim 1 wherein the front portion has an upward facing portion and the front portion further comprises reinforcing ribs provided on the upward facing portion.

6. The surface cleaning head of claim 5 wherein the front portion comprises a single layer of plastic.

7. The surface cleaning head of claim 1 wherein the front portion has a thickness less than 0.1 inch.

8. The surface cleaning head of claim 1 wherein the enclosed passage inlet is positioned proximate a midpoint between the front and rear ends.

9. The surface cleaning head of claim 1 wherein the open sided passage extends rearwardly to a laterally extending passage having a lower extent that is open, the laterally extending passage is provided between a forward depending wall and a rearward depending wall, the entrance to the enclosed passage is provided in the rearward depending wall.

10. The surface cleaning head of claim 9 wherein the lower extent of the laterally extending passage is spaced upwardly from the central portion wherein, when the surface cleaning head is positioned on the surface to be cleaned, a lower surface of the central portion is positioned closer to the surface to be cleaned than the lower extent.

11. The surface cleaning head of claim 9 wherein the laterally extending passage is located rearward of the side portions.

12. The surface cleaning head of claim 1 wherein the central portion has a lateral width that decreases in a rearward direction.

13. The surface cleaning head of claim 1 wherein the lower surface is rigid.

14. The surface cleaning head of claim 1 wherein the front end has an upwardly curved lip.

15. A surface cleaning head comprising:

(a) a front end, a rear end and first and second opposed lateral sides;

(b) a main body having an entrance to an enclosed air flow passage and a front portion that extends forwardly from the enclosed air flow passage, the front portion having a central brushless, planar portion and laterally spaced apart side portions that extend to the first and second opposed lateral sides such that, when the surface cleaning head is positioned on a surface to be cleaned, a lower surface of the front portion is spaced from and faces the surface to be cleaned; and, (c) an air flow passage extending from the front end to an air outlet, the air flow passage includes an open lower sided passage located between the lower surface and the surface to be cleaned when the surface cleaning head is positioned on the surface to be cleaned that extends generally horizontally and rearwardly to the entrance to the enclosed passage, wherein the open sided passage extends rearwardly to a laterally extending passage that extends transverse to a forward direction of travel and has a lower extent that is open, the laterally extending passage is provided between a forward depending wall that is located rearward of the side portions and a rearward depending wall, and extends to each laterally opposed side.

16. The surface cleaning head of claim 15 wherein each side portion has a depending wall that extends downwardly from the central portion and is angled rearwardly and inwardly to define a sidewall of the open sided passage.

17. A surface cleaning head comprising;

(a) a front end, a rear end and first and second opposed lateral sides;

(b) a front portion having a central portion and laterally spaced apart side portions, the side portions extending inwardly from the laterally opposed sides, each of the central and side portions having a lower rigid planar surface that is spaced from and faces a floor when the surface cleaning head is positioned on the floor with the lower surface of the side portions located closer to the floor than the lower surface of the central portion, the central portion extends rearwardly from the front end and the side portions are defined by depending walls located at the lateral sides of the lower surface of the central portion that extend rearwardly and laterally inwardly whereby the central portion has a lateral width that decreases in a rearward direction;

(c) a laterally extending passage positioned rearward of the front portion, the laterally extending passage extending transverse to a forward direction of travel and has a lower extent that is open, the laterally extending passage is provided between a forward depending wall that is located rearward of the side portions and the central portion and a rearward depending wall, and extends to each laterally opposed side; and, (c) an air flow passage extending from the front end to an air outlet, the air flow passage includes an open lower sided passage located between the lower surface of the central and side portions and the surface to be cleaned when the surface cleaning head is positioned on the floor.

18. The surface cleaning head of claim 17 wherein the lower extent of the laterally extending passage is spaced upwardly from the central portion wherein, when the surface cleaning head is positioned on the floor, the lower surface of the central portion is positioned closer to the floor than the lower extent.

19. The surface cleaning head of claim 17 wherein the entrance to the enclosed passage is provided in the rearward depending wall.

20. The surface cleaning head of claim 17 wherein the front end has an upwardly curved lip.

21. The surface cleaning head of claim 17 wherein the surface cleaning head further comprises front wheels that are positioned rearward of the entrance to the enclosed passage.

22. The surface cleaning head of claim 17 wherein the surface cleaning head has an absence of a rotatable mounted brush.

* * * * *